US007865127B2

(12) United States Patent
Nakajima

(10) Patent No.: US 7,865,127 B2
(45) Date of Patent: Jan. 4, 2011

(54) IMAGE FORMING APPARATUS

(75) Inventor: Eiji Nakajima, Osaka (JP)

(73) Assignee: Kyocera Mita Corporation (JP)

( * ) Notice: Subject to any disclaimer, the term of this patent is extended or adjusted under 35 U.S.C. 154(b) by 747 days.

(21) Appl. No.: 11/894,194

(22) Filed: Aug. 20, 2007

(65) Prior Publication Data

US 2008/0044214 A1 Feb. 21, 2008

(30) Foreign Application Priority Data

Aug. 21, 2006 (JP) ..... 2006-224140

(51) Int. Cl.
*G03G 15/00* (2006.01)
*B65H 29/00* (2006.01)
*B65H 29/70* (2006.01)

(52) U.S. Cl. ..... 399/406; 271/176

(58) Field of Classification Search ..... 399/405, 399/406; 271/176
See application file for complete search history.

(56) References Cited

U.S. PATENT DOCUMENTS 5,033,731 A * 7/1991 Looney ..... 271/176
5,823,529 A * 10/1998 Mandel et al. ..... 271/296
5,963,754 A * 10/1999 Itoh et al. ..... 399/21
7,270,324 B2 * 9/2007 Ogata et al. ..... 271/220
7,558,493 B2 * 7/2009 Kwon ..... 399/16

FOREIGN PATENT DOCUMENTS

JP 9-240901 9/1997

* cited by examiner

*Primary Examiner*—Daniel J Colilla
*Assistant Examiner*—Allister Primo
(74) *Attorney, Agent, or Firm*—Gerald E. Hespos; Michael J. Porco

(57) ABSTRACT

An image forming apparatus includes: an image former for performing an image formation by transferring a toner image onto a sheet; a fixing unit for performing a fixing operation with respect to the sheet having the transferred toner image by heating; a discharge tray for successively stacking the sheet to be discharged after the fixing operation; and a curl correcting mechanism for correcting a curl of the sheet to be discharged onto the discharge tray after the fixing operation.

7 Claims, 5 Drawing Sheets

IMAGE FORMING APPARATUS

BACKGROUND OF THE INVENTION

1. Field of the Invention

The present invention relates to an image forming apparatus provided with a sheet curl correcting mechanism.

2. Description of the Related Art

An electrophotographic image forming apparatus is constructed in such a manner that: an electrostatic latent image is formed on the surface of a photosensitive drum by light irradiation from an exposure device based on predetermined image information; a toner image is formed on the surface of the photosensitive drum by supplying toner particles onto the electrostatic latent image by a developing device; and the toner image is transferred onto a sheet. Then, the toner image transferred to the sheet is fixed by a fixing device, followed by discharge of the sheet carrying the fixed toner image.

The fixing device includes a fixing roller internally provided with a heater for heating the fixing roller, and a pressure roller disposed as opposed to the fixing roller, with its surface being contacted with the surface of the fixing roller. The sheet after the transfer operation is subjected to a fixing operation by being heated by the fixing roller, while passing through a nip portion between the rotating fixing roller and the pressure roller.

When the sheet passes through the nip portion, one surface of the sheet having the transferred toner image is heated by the fixing roller, and the other surface of the sheet is contacted with the pressure roller whose surface temperature is lower than that of the fixing roller. As a result, the one surface of the sheet is subjected to thermal expansion. Thereby, widthwise ends of the sheet discharged from the fixing device may be warped toward the pressure roller, in other words, a curl may be formed on the sheet. When the curl is formed on the sheet, the entire thickness of the sheet may be unduly increased, with the result that the discharge tray may be incapable of holding a predetermined amount of sheets.

In order to solve the above drawback, Japanese Unexamined Patent Publication No. 9-240901 discloses a curl correcting mechanism including a curl amount detecting sensor for detecting the curl amount of a sheet discharged on a discharge tray, and a decurler for correcting the curl. When the curl amount detecting sensor detects a curl of a sheet, the decurler is activated to correct the curl of the sheet, and thereafter, the sheet with its curl being corrected is discharged onto the discharge tray. The curl amount detecting sensor continues to detect the curl amount of a sheet to be successively discharged onto the discharge tray, and judges whether a further sheet is allowed to be discharged onto the discharge tray. If it is judged that no more sheet discharging operation is allowed, the sheet discharging operation is suspended.

The curl correcting mechanism recited in the above publication has some drawbacks. Firstly, the decurler is provided upstream of the discharge tray. Specifically, even if a curl of a sheet is corrected by the decurler, the sheet may return to a curled state while being transported along a transport path toward the discharge tray. As a result, the sheet whose curl correction is incomplete may be discharged on the discharge tray.

Secondly, the curl correcting mechanism may be costly, which may resultantly increase the production cost of the image forming apparatus. The decurler generally includes a pair of rollers, a belt wound between the roller pair, and a correction roller biased against a forward portion of the belt.

Thirdly, the curl correcting mechanism is constructed in such a manner that the sheet discharging operation is suspended based on the curl amount of the sheet detected on the discharge tray. In this arrangement, the sheet discharging operation may be suspended despite that a further sheet discharging operation is possible under an actually small curl amount of the sheet on the discharge tray. As result, the sheet processing performance of the image forming apparatus may be degraded.

SUMMARY OF THE INVENTION

In view of the above problems residing in the prior art, it is an object of the invention to provide an image forming apparatus that enables to prevent a sheet stacking capacity of a discharge tray from lowering resulting from a curl of a sheet discharged on the discharge tray.

An image forming apparatus according to an aspect of the invention includes: an image former for performing an image formation by transferring a toner image onto a sheet; a fixing unit for performing a fixing operation with respect to the sheet having the transferred toner image by heating; a discharge tray for successively stacking the sheet to be discharged after the fixing operation; and a curl correcting mechanism for correcting a curl of the sheet to be discharged onto the discharge tray after the fixing operation.

These and other objects, features and advantages of the present invention will become more apparent upon reading the following detailed description along with the accompanying drawing.

DETAILED DESCRIPTION OF THE PREFERRED EMBODIMENTS

Figure 1:
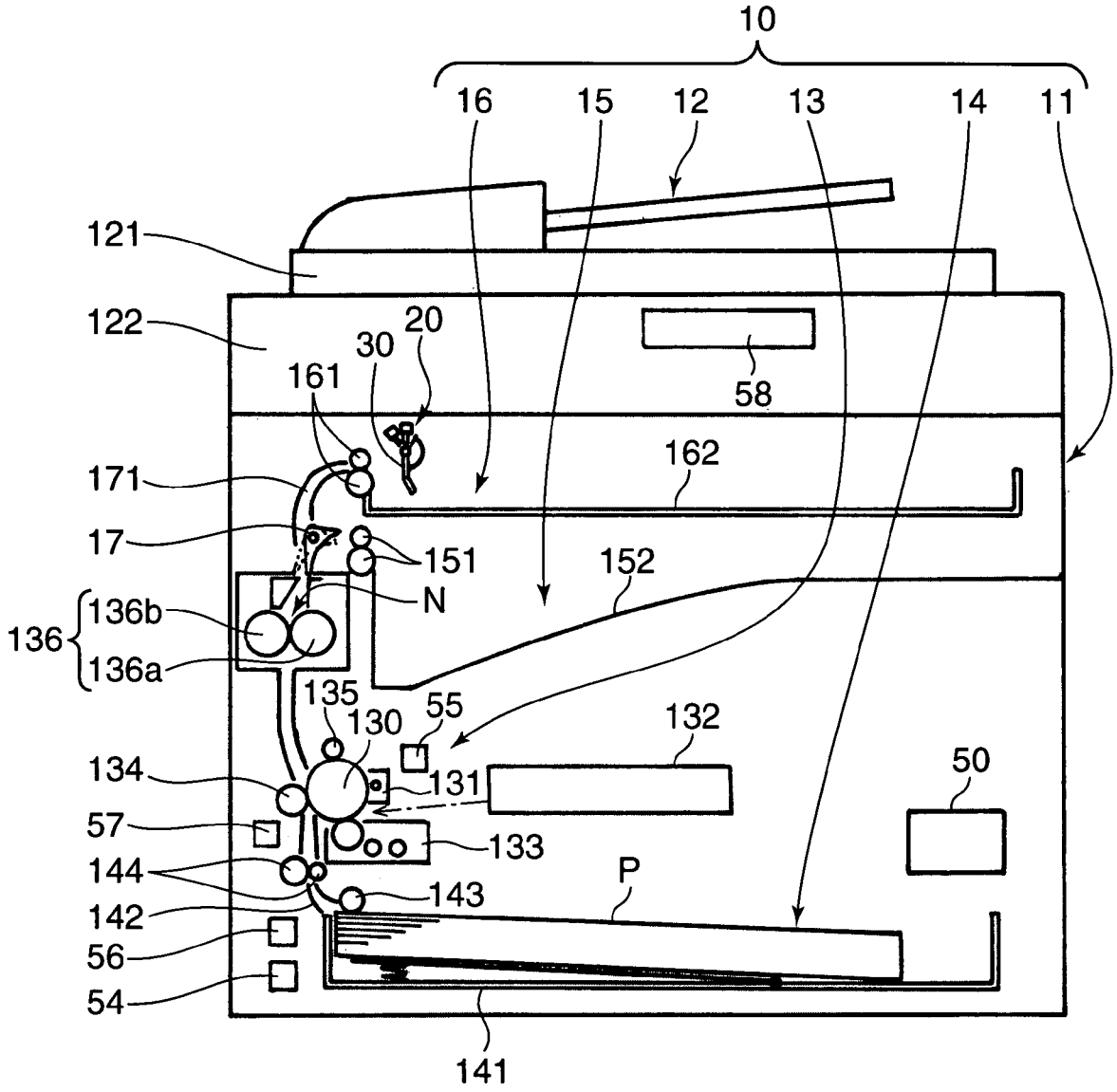
FIG. 1 is a cross-sectional view schematically showing an internal structure of a copier embodying the invention.

FIG. 1 is a cross-sectional view schematically showing an internal structure of a copier 10, as an example of an image forming apparatus embodying the invention. In this embodiment, the copier 10 is a complex machine provided with various functions such as a facsimile function in addition to a copying function.

As shown in FIG. 1, the copier 10 i.e. the image forming apparatus 10 has a box-shaped main body 11, in which a document reader 12, an image former 13, a sheet feeder 14, a primary discharging portion 15, and a job separator discharging portion 16 or a secondary discharging portion 16 are provided. The document reader 12 is provided on a top part of the copier main body 11. The image former 13 is provided substantially in the middle of the copier main body 11. The sheet feeder 14 is provided at a position below the image former 13 in the copier main body 11. The primary discharging portion 15 is formed immediately above the image former 13, and is integrally formed with the copier main body 11. The job separator discharging portion 16 is formed between the primary discharging portion 15 and the document reader 12.

The document reader 12 has a scanner 122 for generating image data based on an optically read document image, and includes a first contact glass and a second contact glass on an upper surface of the scanner 122. The first contact glass is used by a user so that the user opens a document holder 121 closably and openably mounted on a top surface of the copier main body 11 and manually places a document thereon. The first contact glass has such a size as to cover substantially the entire surface of a middle portion on the top surface of the copier main body 11. The second contact glass is used in automatically and sequentially reading images of documents placed on the document holder 121. The image data of the documents placed on the document holder 121 is sequentially read by the scanner 122 from the document in contact with the second contact glass by driving a document transport mechanism.

The sheet feeder 14 includes a detachably mounted sheet cassette 141 in which sheets P for image transfer operation are accommodated. The sheet feeder 14 has a transport path 142 along which the sheet P is transported from the sheet cassette 141 to the image former 13. The sheet cassette 141 has a pickup roller 143 for dispensing the sheets P accommodated therein one by one. A pair of feeding rollers 144 are provided at an appropriate position on the transport path 142 to feed the sheet P dispensed by the pickup roller 143 toward the image former 13.

The image former 13 has a photosensitive drum 130 rotatably supported about an axis of rotation of the photosensitive drum 130. A charger 131, an exposure unit 132, a developer 133, a transferer 134, and a cleaner 135 are arranged around the surface of the photosensitive drum 130. A fixing unit 136 is provided at a position above the photosensitive drum 130.

The charger 131 uniformly charges the surface of the photosensitive drum 130 with a predetermined potential. The exposure unit 132 irradiates a laser beam onto the surface of the photosensitive drum 130 based on the read image data to form an electrostatic latent image on the surface of the photosensitive drum 130.

The developer 133 forms a toner image by magnetically attracting toner particles onto the electrostatic latent image. The transferer 134 transfers the toner image onto the sheet P that has been transported to the image former 13. In the example shown in FIG. 1, the transferer 134 includes a transfer roller. The cleaner 135 removes the toner residuals on the surface of the photosensitive drum 130 after the image transfer for cleaning so that the image former 13 is ready for a next electrostatic latent image formation.

The fixing unit 136 fixes the toner image transferred to the sheet P. As shown in FIG. 1, the fixing unit 136 includes a fixing roller 136*a* and a pressure roller 136*b* juxtaposed to each other. In the example shown in FIG. 1, the fixing roller 136*a* is disposed on the right, and the pressure roller 136*b* is disposed on the left. The fixing roller 136*a* is rotated clockwise in FIG. 1 about an axis of rotation thereof by a driving force of an unillustrated drive mechanism. The pressure roller 136*b* is rotated counterclockwise about an axis of rotation thereof, while being driven by the fixing roller 136*a*.

The fixing roller 136*a* is internally provided with an energization heater such as a halogen lamp. The energization heater is heated when an electric power is supplied thereto from an unillustrated power source device. The fixing roller 136*a* is heated by the heating of the energization heater.

The pressure roller 136*b* has its surface pressed against the surface of the fixing roller 136*a* by a biasing force of a bias member. A nip portion N is defined at a contact position of the pressure roller 136*b* and the fixing roller 136*a* to nip the sheet P after an image transfer operation in the image former 13. With this arrangement, when the sheet P after the image transfer operation reaches the nip portion N, the sheet P is guided upward by the driving rotation of the fixing roller 136*a*. While the sheet P is guided through the nip portion N, the toner image on the sheet P is fixed by the heat supplied from the fixing roller 136*a*.

A switching guide 17 is provided at a position above the exit of the fixing unit 136 for switching the transport destination of the sheet P after the fixing operation between the primary discharging portion 15 and the job separator discharging portion 16. The sheet P transported from the fixing unit 136 is selectively discharged to the primary discharging portion 15 or the job separator discharging portion 16 by a switching operation of the switching guide 17.

The primary discharging portion 15 includes a lower-located discharge roller pair 151 disposed immediately right of the switching guide 17, and a primary discharge tray 152 formed on the right of the lower-located discharge roller pair 151 in FIG. 1. The primary discharge tray 152 has a slope downwardly inclined from right to left in FIG. 1. With this arrangement, a significantly large height difference is defined between a left end of the primary discharge tray 152 and the lower-located discharge roller pair 151. Accordingly, even if the sheet P is curled by the heat of the fixing operation in the fixing unit 136, the sheet P is securely and successively discharged onto the primary discharge tray 152 via the lower-located discharge roller pair 151.

The job separator discharger 16 includes an upper-located discharge roller pair 161 disposed at an upstream end, and a flat job separator tray 162, as a discharge tray, which extends rightward from an immediately right position of the upper-located discharge roller pair 161 in FIG. 1.

The job separator tray 162 is adapted to discharge a printed sheet P, in the case where the copier 10 is used as a facsimile machine, and an image sent from a sender facsimile machine is processed by the image former 13. In the case where the copier 10 is used as a copying machine of copying a document, which is a primary function of the copier 10, a copied sheet P is discharged onto the primary discharge tray 152.

In this way, the discharge destination of the sheet P differs depending on the purpose of use of the copier 10. With this arrangement, the user can easily recognize whether the discharged sheet P is a printed sheet carrying a fax message transmitted from a sender facsimile machine, or a copied sheet obtained by a copying operation of the copier 10. This enables to eliminate a user's cumbersome operation of discriminating copied sheets from printed sheets carrying a fax message, unlike an arrangement that the copied sheets and the printed sheets carrying the fax message are mixed in the discharged sheets.

The copier 10 is designed in such a manner that a copying operation is prioritized. Therefore, it is often the case that the sheet stacking capacity of the job separator tray 162 provided in association with a facsimile operation is set smaller than that of the primary discharge tray 152 provided in association with a copying operation. As a result, the sheet P discharged on the job separator tray 162 is likely to be affected by curl of a sheet. In view of this, in the embodiment, a sheet presser 30 as an element of a curl correcting mechanism 20 to be described later in detail is provided at a position immediately right and slightly above the upper-located discharge roller pair 161 for use in a facsimile operation. A reduced curl amount of a sheet P by the sheet presser 30 enables to prevent the sheet stacking capacity of the job separator tray 162 from lowering.

A discharge transport path 171 is formed between the upper-located discharge roller pair 161 and the fixing unit 136 to guide the sheet P after the fixing operation to the job separator tray 162 via the switching guide 17. The sheet P fed from the fixing unit 136 is discharged onto the job separator 162 along the discharge transport path 171 in a state that the switching guide 17 is set to a position indicated by the solid line in FIG. 1 for guiding the sheet P toward the job separator tray 162.

The copier 10 having the above arrangement is provided with a sheet feeder drive source 54, an image former drive source 55, a charger power source device 56, and a transferer power source device 57 at appropriate positions in the copier machine 11. The sheet feeder drive source 54 has a drive motor and a gear mechanism, and supplies a driving force to the pickup roller 143 and the feeding roller pair 144 of the sheet feeder 14.

Similarly to the sheet feeder drive source 54, the image former drive source 55 also has a drive motor and a gear mechanism, and supplies a driving force to the photosensitive drum 130, the developer 133, and the cleaner 135 in synchronism to each other.

The charger power source device 56 applies a predetermined high voltage to a charging wire of the charger 131 in synchronism with the driving rotation of the photosensitive drum 130. The transferer power source device 57 applies a predetermined voltage to the transfer roller of the transferer 134 in synchronism with the driving rotation of the photosensitive drum 130.

Figure 2:
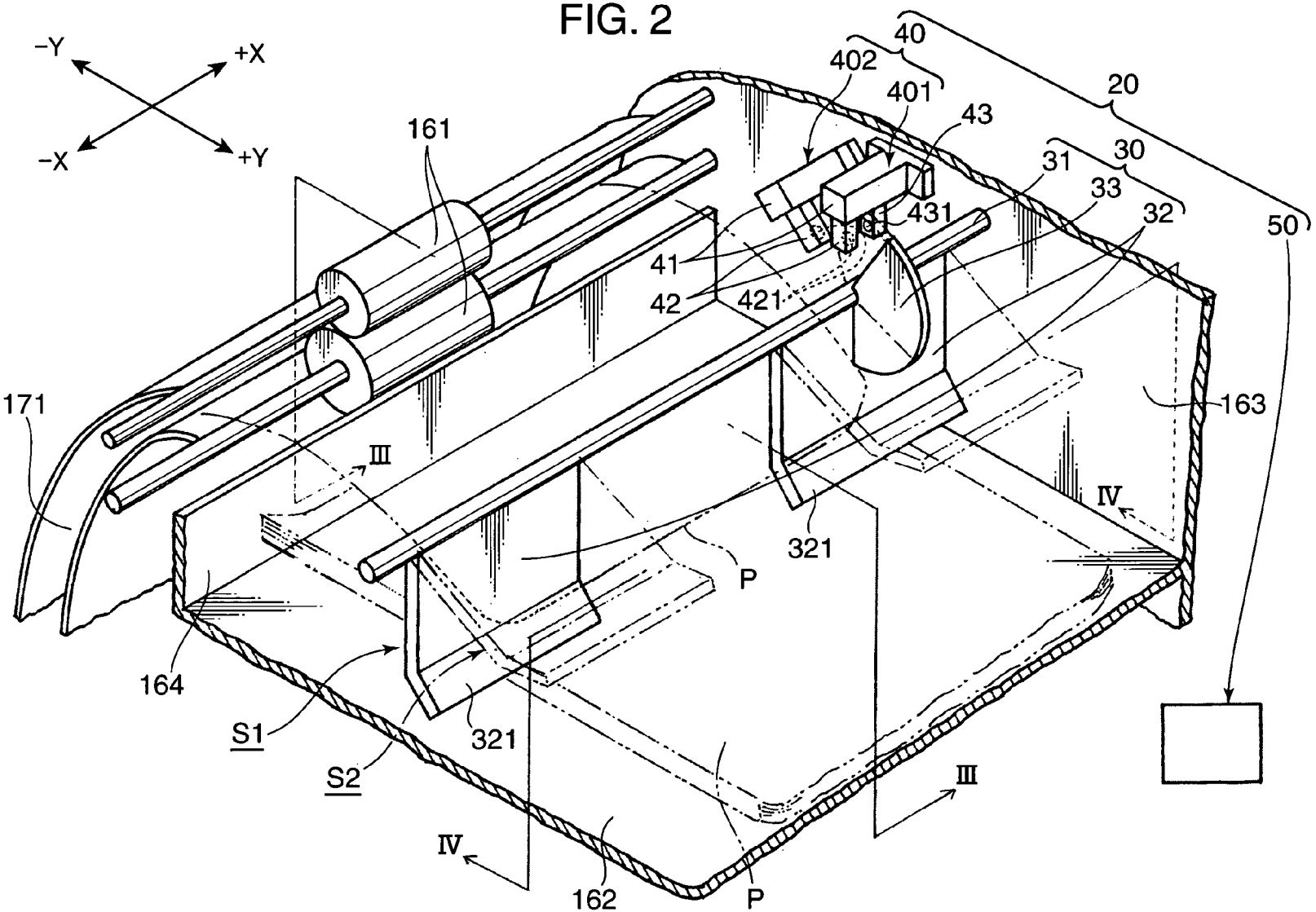
FIG. 2 is a perspective view showing an embodiment of a curl correcting mechanism.
Figure 3:
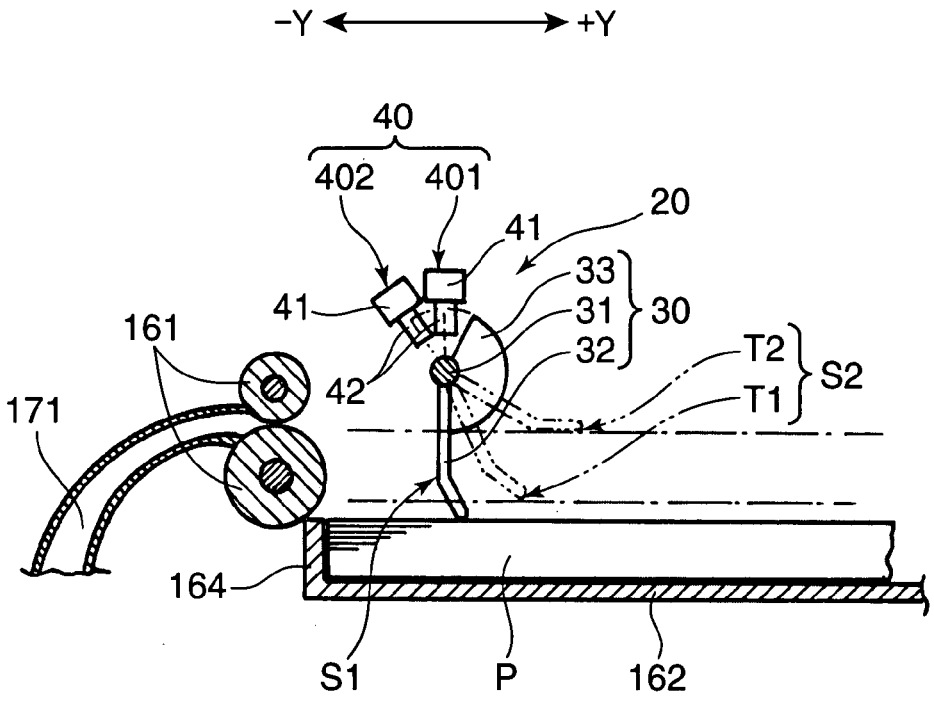
FIG. 3 is a cross-sectional view taken along the line III-III in FIG. 2.
Figure 4:
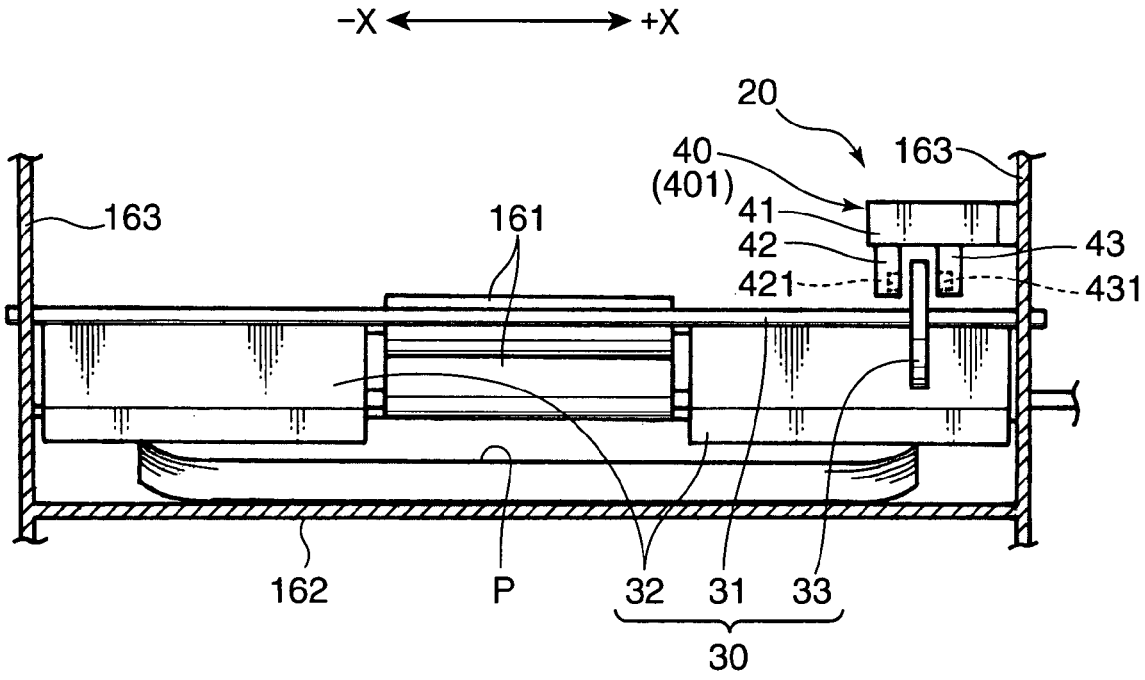
FIG. 4 is a cross-sectional view taken along the line IV-IV in FIG. 2.

In the following, the curl correcting mechanism 20 provided in association with the job separator tray 162 is described referring to FIGS. 2 through 4. FIG. 2 is a perspective view showing an embodiment of the curl correcting mechanism 20. FIG. 3 is a cross-sectional view taken along the line III-III in FIG. 2. FIG. 4 is a cross-sectional view taken along the line IV-IV in FIG. 2. In FIGS. 2 through 4, X-X directions are called as left and right directions, and Y-Y-directions are called as forward and backward directions, and specifically, −X direction is called as leftward direction, +X direction is called as rightward direction, −Y direction is called as forward direction, and +Y direction is called as backward direction, respectively.

As shown in FIGS. 2 through 4, the curl correcting mechanism 20 includes the sheet presser 30, a position sensor 40, and a controller 50. The sheet presser 30 is a member whose sheet pressing position is moved upward in accordance with an increase in the number of discharged sheets, while suppressing curl of the sheet P discharged on the job separator tray 162. The position sensor 40 detects the sheet pressing position of the sheet presser 30. The controller 50 controls a sheet transport operation in such a manner that the sheet P is transported with its curl being suppressed, based on a detection result of the position sensor 40.

The sheet presser 30 includes a support rod 31 mounted between a pair of widthwise side walls 163 on which lateral ends of the job separator tray 162 are fixed; a pair of curl suppressing plates 32 which are disposed in a sheet widthwise direction, extend radially outwardly from the support rod 31, and are integrally fixed at both end portions of the support rod 31, respectively; and a fan-shaped light blocker 33 which is integrally fixed to the support rod 31 at a position corresponding to the right-side curl suppressing plate 32 in FIG. 2. In FIG. 2, merely the right-side side wall 163 is illustrated. The side wall pair 163 serve as left and right frame walls constituting the copier main body 11.

The support rod 31 is provided at a position slightly above an upper end of a front wall 164 extending upright from a front end of the job separator tray 162, and at a position slightly above a maximal height level of sheets loadable on the job separator tray 162. The front wall 164 has such dimensions that the upper end of the front wall 164 is located slightly below the nip position of the upper-located discharge roller pair 161. With this arrangement, the sheet P transported from the upper-located discharge roller pair 161 toward the job separator tray 162 is discharged onto the job separator tray 162 without an interference with the front wall 164 and the support rod 31.

The curl suppressing plates 32 each is formed of a rectangular flat plate made of a material whose specific gravity is large such as iron or stainless steel. Since the constructions of the curl suppressing plates 32 are substantially identical to each other, description is made with respect to one of the curl suppressing plates 32 in the following. The curl suppressing plate 32 is selectively set to a suspended position S1 (indicated by the solid line in FIG. 2) where the curl suppressing plate 32 is suspended from the support rod 31 by the own weight, and a correcting position S2 (indicated by the two-dotted chain line in FIG. 2) capable of pressingly correcting a curl of a sheet P discharged on the job separator tray 162 by an integral pivotal movement with the support rod 31 about the axis thereof.

The length of the curl suppressing plate 32 from a base end thereof to a distal end thereof is so defined that the distal end is kept slightly above from the top surface of the job separator tray 162 when the curl suppressing plate 32 is set to the suspended position S1. The curl suppressing plate 32 has a slope 321 by bending the distal end thereof with a predetermined angle counterclockwise about the axis of the support rod 31.

The fan-shaped light blocker 33 is a member for blocking an optical path formed in the position sensor 40 for position detection. Specifically, the fan-shaped light blocker 33 causes the position sensor 40 to detect whether a lead end of the slope 321 of the right-side curl suppressing plate 32 (see FIG. 2) has reached a predetermined reference height position T1 (see FIG. 3), as a predetermined reference height level, which is a reference position to be used in determining whether the number of sheets P to be processed by the copier 10 per unit time is to be reduced, and to detect whether the slope 321 of the curl suppressing plate 32 has reached a maximally loadable position T2 (see FIG. 3) corresponding to a condition that the job separator tray 162 is maximally loaded with sheets.

The fan-shaped light blocker 33 is an arc-shaped plate member, and is attached to a rear surface of the right-side curl suppressing plate 32 in a state that the fan-shaped light blocker 33 extends substantially orthogonal to the curl suppressing plate 32, with a center of curvature thereof being coincident with the axis of the support rod 31. In this embodiment, the center angle of the fan-shaped light blocker 33 is set slightly smaller than 180°. The radius of curvature of the fan-shaped light blocker 33 is set substantially half of the protruded amount of the curl suppressing plate 32 from the support rod 31. The center angle and the radius of curvature of the fan-shaped light blocker 33 may be set to a proper value depending on a condition such as a positional relation relative to the position sensor 40.

The position sensor 40 includes a first sensor 401, as a first detecting member, for detecting whether the lead end of the curl suppressing plate 32 has reached the reference height position T1, and a second sensor 402, as a second detecting member, for detecting whether the lead end of the curl suppressing plate 32 has reached the maximally loadable position T2.

The first sensor 401 is provided at a position immediately above the support rod 31 in a state that the first sensor 401 partially overlaps the trajectory of the fan-shaped light blocker 33 about the axis of the support rod 31. The second sensor 402 is provided at a position slightly forward of the first sensor 401 in a state that the second sensor 402 partially overlaps the trajectory of the fan-shaped light blocker 33 about the axis of the support rod 31, similarly to the first sensor 401.

The first sensor 401 and the second sensor 402 each includes a box-shaped casing 41 fixed to the side wall 163; a downwardly extending left projecting piece 42 and a downwardly extending right projecting piece 43 provided at such a position that the left and right projecting pieces 42 and 43 partially overlap the trajectory of the fan-shaped light blocker 33; a light emitter 421 mounted on the left projecting piece 42, as opposed to the right projecting piece 43; and a light receiver 431 mounted on the right projecting piece 43, as opposed to the light emitter 421.

In the above arrangement, before the fan-shaped light blocker 33 is moved between the left projecting piece 42 and the right projecting piece 43 of the first sensor 401, light emitted from the light emitter 421 of the first sensor 401 is received on the light receiver 431. In this state, the first sensor 401 outputs, to the controller 50, a detection signal indicating that the curl suppressing plate 32 has not reached the reference height position T1, based on a light receiving signal from the light receiver 431.

On the other hand, at the point of time when the fan-shaped light blocker 33 comes between the left projecting piece 42 and the right projecting piece 43 of the first sensor 401, the light emitted from the light emitter 421 of the first sensor 401 is blocked by the fan-shaped light blocker 33. Then, the first sensor 401 outputs, to the controller 50, a detection signal that the curl suppressing plate 32 has reached the reference height position T1, because the light receiver 431 does not generate a light receiving signal.

Thereafter, before the fan-shaped light blocker 33 is moved between the left projecting piece 42 and the right projecting piece 43 of the second sensor 402, light emitted from the light emitter 421 of the second sensor 402 is received by the light receiver 431. In this state, the second sensor 402 detects that the curl suppressing plate 32 has not reached the maximally loadable position T2. On the other hand, at the point of time when the fan-shaped light blocker 33 comes between the left projecting piece 42 and the right projecting piece 43 of the second sensor 402, the light emitted from the light emitter 421 of the second sensor 402 is blocked by the fan-shaped light blocker 33. Then, the second sensor 401 outputs, to the controller 50, a detection signal that the curl suppressing plate 32 has reached the maximally loadable position T2, because the light receiver 431 does not generate a light receiving signal.

The controller 50 controls a processing performance i.e. an image forming performance of the image former 13, specifically, controls the number of sheets P to be processed by the image former 13 per unit time, based on a detection signal from the position sensor 40 i.e. the first and the second sensors 401 and 402. For instance, the controller 50 controls the fixing unit 136 to suppress curl formation on the sheet P by reducing the number of sheets P to be processed by the image former 13 per unit time.

In this embodiment, the number of sheets P to be processed by the image former 13 per unit time is reduced by delaying a timing of feeding a sheet P from the sheet feeder 14 to the image former 13, without changing the rotation number of the photosensitive drum 130 or the rotation number of the fixing roller 136*a* per unit time. Specifically, a time interval from the point of time when a preceding sheet P has been fed from the sheet feeder 14 to the image former 13 to the point of time when a succeeding sheet P is fed from the sheet feeder 14 to the image former 13 is set longer than a time interval set in a normal operation mode of the copier 10 for the following reason.

In the fixing unit 136, a sheet P is subjected to a fixing operation by the heat supplied from the fixing roller 136*a* in a condition that the sheet P is pressingly held between the high-temperature fixing roller 136*a* provided with the internal heater, and the pressure roller 136*b* without an internal heater. Therefore, the thermal expansion amount on one surface of the sheet P in contact with the fixing roller 136*a* is larger than that on the other surface of the sheet P in contact with the pressure roller 136*b*. As a result, widthwise ends of the sheet P is likely to be warped from the one surface toward the other surface of the sheet P, with the result that a curl may be formed.

In view of the above, by approximating the surface temperature of the pressure roller 136*b* to the surface temperature of the fixing roller 136*b* as much as possible, a temperature difference between the both surfaces of the sheet P which is pressingly held between the fixing roller 136*a* and the pressure roller 136*b* is minimized. Thereby, a difference in thermal expansion amount between the both surfaces of the sheet P is reduced, which enables to reduce the curl amount of the sheet P.

In this embodiment, the number of sheets P to be processed per unit time is reduced to increase a contact time of the fixing roller 136*a* with the pressure roller 136*b* for the purpose of approximating the surface temperature of the pressure roller 136*b* to the surface temperature of the fixing roller 136*a*. Specifically, a timing of transporting a sheet P from the sheet feeder 14 to the image former 13 is delayed, as compared with a corresponding timing set in the normal operation mode.

If, however, the number of sheets P to be processed per unit time is constantly decreased, the image forming performance of the copier 10 is lowered despite the advantage that curl formation of the sheets P is suppressed. In view of this, the controller 50 controls the number of sheets P to be processed per unit time, based on the height of the sheets P discharged on the job separator tray 162 i.e. based on a detection result of the position sensor 40 i.e. the first and the second sensors 401 and 402, while suppressing lowering of the image forming performance of the copier 10 as much as possible.

Figure 5:
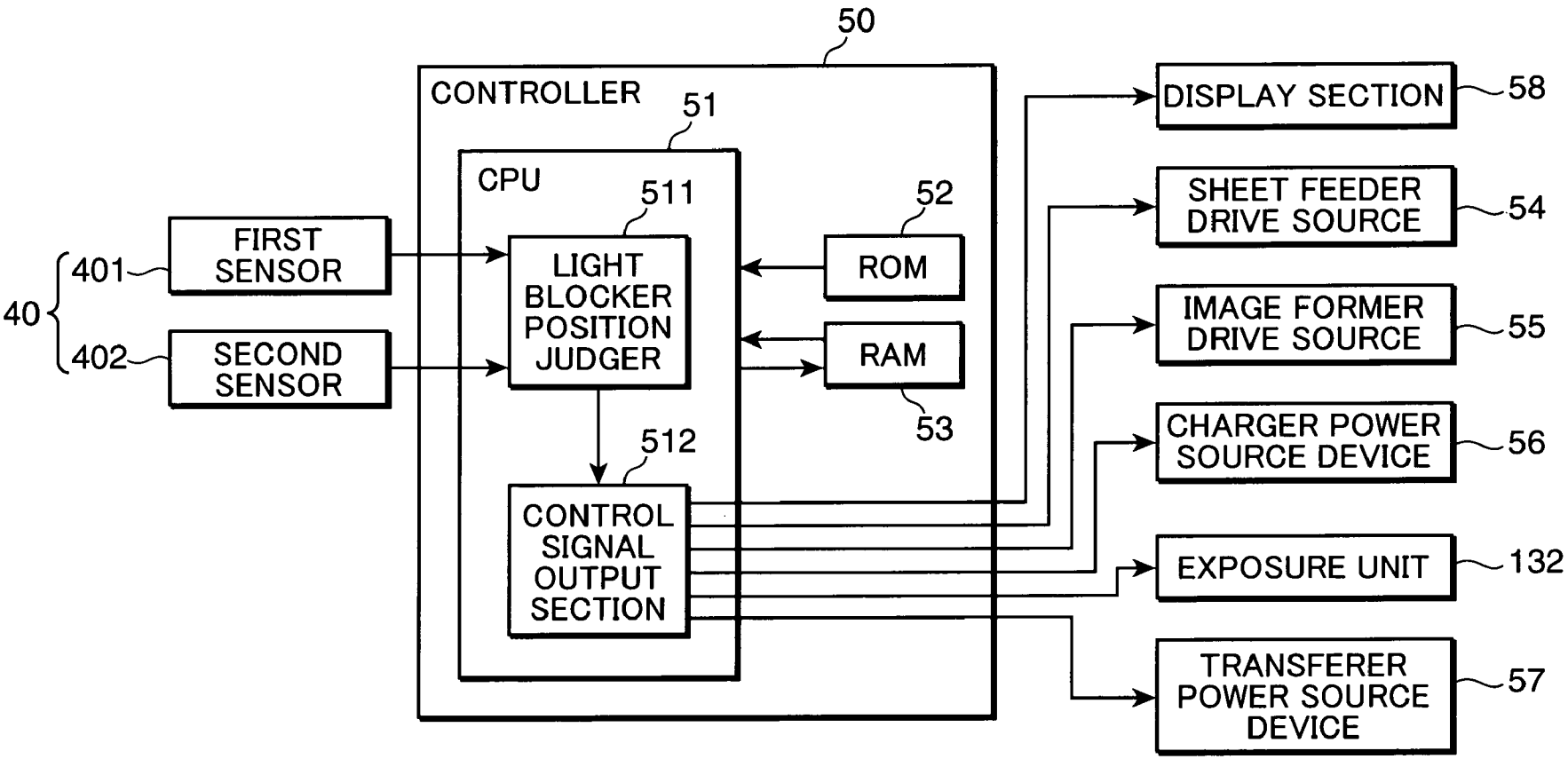
FIG. 5 is a block diagram showing an embodiment of a controller.

FIG. 5 is a block diagram showing an embodiment of the controller 50. The controller 50 performs overall control operations concerning driving of the copier 10. FIG. 5 primarily shows functional blocks relating to the control concerning the number of sheets P to be processed per unit time. As shown in FIG. 5, the controller 50 includes a CPU (Central Processing Unit) 51, an ROM (Read Only Memory) 52, and an RAM (Random Access Memory) 53.

The ROM 52 stores therein a program for executing the aforementioned control, invariable data, and the like. The RAM 53 is utilized as a work area for temporarily storing various data generated in the course of the control.

The CPU 51 includes a light blocker position judger 511 for receiving a detection signal from the first and the second sensors 401 and 402, and a control signal output section 512 for outputting a control signal to the relevant parts of the copier 10, based on a judgment result of the light blocker position judger 511.

The light blocker position judger 511 judges whether the curl suppressing plate 32 has reaches the reference height position T1 or the maximally loadable position T2, based on a detection signal from the first and the second sensors 401 and 402, as the sheets P are sequentially discharged onto the job separator tray 162. The judgment result from the light blocker position judger 511 is outputted to the control signal output section 512.

Specifically, when a predetermined number of sheets P are discharged onto the job separator tray 162, the fan-shaped light blocker 33 comes between the left projecting piece 42 and the right projecting piece 43 of the first sensor 401 resulting from a pivotal rotation of the curl suppressing plate 32. Then, the light from the light emitter 421 is blocked by the fan-shaped light blocker 33. Thereby, the light receiver 431 is incapable of receiving the light from the light emitter 421, and the first sensor 401 detects that the curl suppressing plate 32 has reached the reference height position T1. The detection signal from the first sensor 401 is inputted to the light blocker position judger 511.

Then, in response to receiving the detection signal from the first sensor 401, the light blocker position judger 511 judges that the curl suppressing plate 32 has reached the reference height position T1, and outputs the judgment result to the control signal output section 512.

Upon receiving the judgment result from the light blocker position judger 511 indicating that the curl suppressing plate 32 has reached the reference height position T1, the control signal output section 512 outputs a predetermined control signal to the relevant parts i.e. the sheet feeder drive source 54, the image former drive source 55, the charger power source device 56, the exposure unit 132, and the transferer power source device 57. Upon receiving the respective control signals, the sheet feeder drive source 54, the image former drive source 55, the charger power source device 56, the exposure unit 132, and the transferer power source device 57 are driven at a predetermined delay mode. Thereby, the number of sheets P to be fed from the sheet cassette 141 to the image former 13 per unit time is reduced, as compared with the normal operation mode, by increasing the transport time interval between the preceding sheet P and the succeeding sheet P, in other words, by increasing a transport interval between the preceding sheet P and the succeeding sheet P.

The sheet feeder drive source 54 supplies a driving force to the pickup roller 143 and the feeding roller pair 144. When the copier 10 is brought to the delay mode, the driving of the pickup roller 143 and the feeding roller pair 144 is suspended until lapse of a predetermined time after a sheet P has been fed toward the image former 13. Thereby, a longer time interval is defined between the point of time when the preceding sheet P has been fed toward the image former 13, and the point of time when the succeeding sheet P is fed toward the image former 13, as compared with the normal operation mode. The transport speed of the sheet P in the delay mode is substantially the same as that in the normal operation mode.

The image former drive source 55 supplies a driving force to a developing roller of the developer 133, a spiral feeder for stirring toner, or a like device in synchronism to each other. When the copier 10 is brought to the delay mode, the image former drive source 55 cyclically repeats driving and suspension of the driving in synchronism with a sheet feeding operation of the sheet feeder 14 at an increased feeding interval.

The charger power source device 56 applies a high voltage to the charging wire of the charger 131. When the copier 10 is brought to the delay mode, the timing of applying a voltage to the charging wire is changed from the voltage application timing set in the normal operation mode to a corresponding timing in the delay mode. The timing of irradiating a laser beam from the exposure unit 132 is also changed in synchronism with the change of the voltage application timing.

The transferer power source device 57 applies a predetermined voltage to the transfer roller of the transferer 134 to form an electric charge with a polarity opposite to the polarity of a toner image to be formed on the surface of the photosensitive drum 130. By the voltage application, the toner image formed on the surface of the photosensitive drum 130 is electrostatically peeled away, whereby the toner image is transferred onto the sheet P. In response to changeover of the operation mode of the copier 10 from the normal operation mode to the delay mode, the transferer power source device 57 applies a voltage to the transfer roller at a delayed timing, as compared with the normal operation mode, in synchronism with the rotation of the photosensitive drum 130.

The fixing roller 136*a* and the pressure roller 136*b* of the fixing unit 136 are continued to be rotated irrespective of the changeover of the operation mode of the copier 10 from the normal operation mode to the delay mode.

In the above arrangement, when the light blocker position judger 511 judges that the operation mode of the copier 10 should be changed to the delay mode, i.e., the curl suppressing plate 32 has reached the reference height position T1, based on the detection result of the first sensor 401, the control signal output section 512 issues a control signal to the relevant parts of the copier 10 to increase the time interval of feeding the sheet P from the sheet feeder 14 to the image former 13, as compared with the normal operation mode. When the copier 10 is brought to the delay mode, the respective parts of the copier 10 such as the photosensitive drum 130 and the transfer roller are intermittently driven. On the other hand, the fixing unit 136 is continuously driven in the same manner as in the normal operation mode.

In the above arrangement, upon reaching the fixing unit 136 from the sheet feeder 14 via the image former 13, the sheet P is subjected to a fixing operation, and then, a next sheet P is fed to the image former 13 with a predetermined increased time interval. During the time interval, the surface of the fixing roller 136*a* is directly contacted with the surface of the pressure roller 136*b*. As a result, the surface temperature difference between the fixing roller 136*a* and the pressure roller 136*b* is reduced due to direct heat transmission from the surface of the fixing roller 136*a* to the surface of the pressure roller 136*b*.

By performing the above operations, the curl amount of the sheet P discharged on the job separator tray 162 after the point of time when the curl suppressing plate 32 has reached the reference height position T1 is reduced, as compared with the sheet P that has been discharged on the job separator tray 162 before the copier 10 is changed to the delay mode. Accordingly, the sheet stacking capacity of the job separator tray 162 is increased after the copier 10 is changed to the delay mode, as compared with the condition before the copier 10 is changed to the delay mode.

Subsequently, when the fan-shaped light blocker 33 is detected by the second sensor 402 by further pivotal rotation of the curl suppressing plate 32 resulting from further sheet discharging operation, the detection signal of the second sensor 402 is inputted to the light blocker position judger 511. Then, the light blocker position judger 511 judges that the curl suppressing plate 32 has reached the maximally loadable position T2, and outputs the judgment result to the control signal output section 512.

Upon receiving the judgment result, the control signal output section 512 outputs a control signal to the sheet feeder drive source 54, the image former drive source 55, the charger power source device 56, the exposure unit 132, and the transferer power source device 57 to suspend the driving thereof, whereby the driving of these parts is suspended. Thus, the arrangement enables to prevent likelihood that a sheet P may be discharged on the job separator tray 162 beyond the sheet stacking capacity of the job separator tray 162, thereby causing sheet jam.

In this embodiment, a display section 58 is provided at an appropriate position of the copier main body 11. In response to receiving the judgment result from the light blocker position judger 511 indicating that the curl suppressing plate 32 has reached the maximally loadable position T2, the control signal output section 512 causes the display section 58 to display a message indicating that no more sheet P is discharged, e.g. "The job separator tray is full. Sheet discharge is suspended. Please remove the sheets from the job separator tray."

When the user removes the sheets P from the job separator tray 162 in accordance with the message, the control signal output section 512 outputs a control signal to the relevant parts such as the sheet feeder drive source 54 and the image former drive source 55 to resume the driving thereof. By resuming the driving, a sheet or sheets P which may remain in the copier main body 11 is or are discharged onto the job separator tray 162. After the removal of the sheet(s) P from the job separator tray 162, the copier 10 is returned to the normal operation mode.

Figure 6:
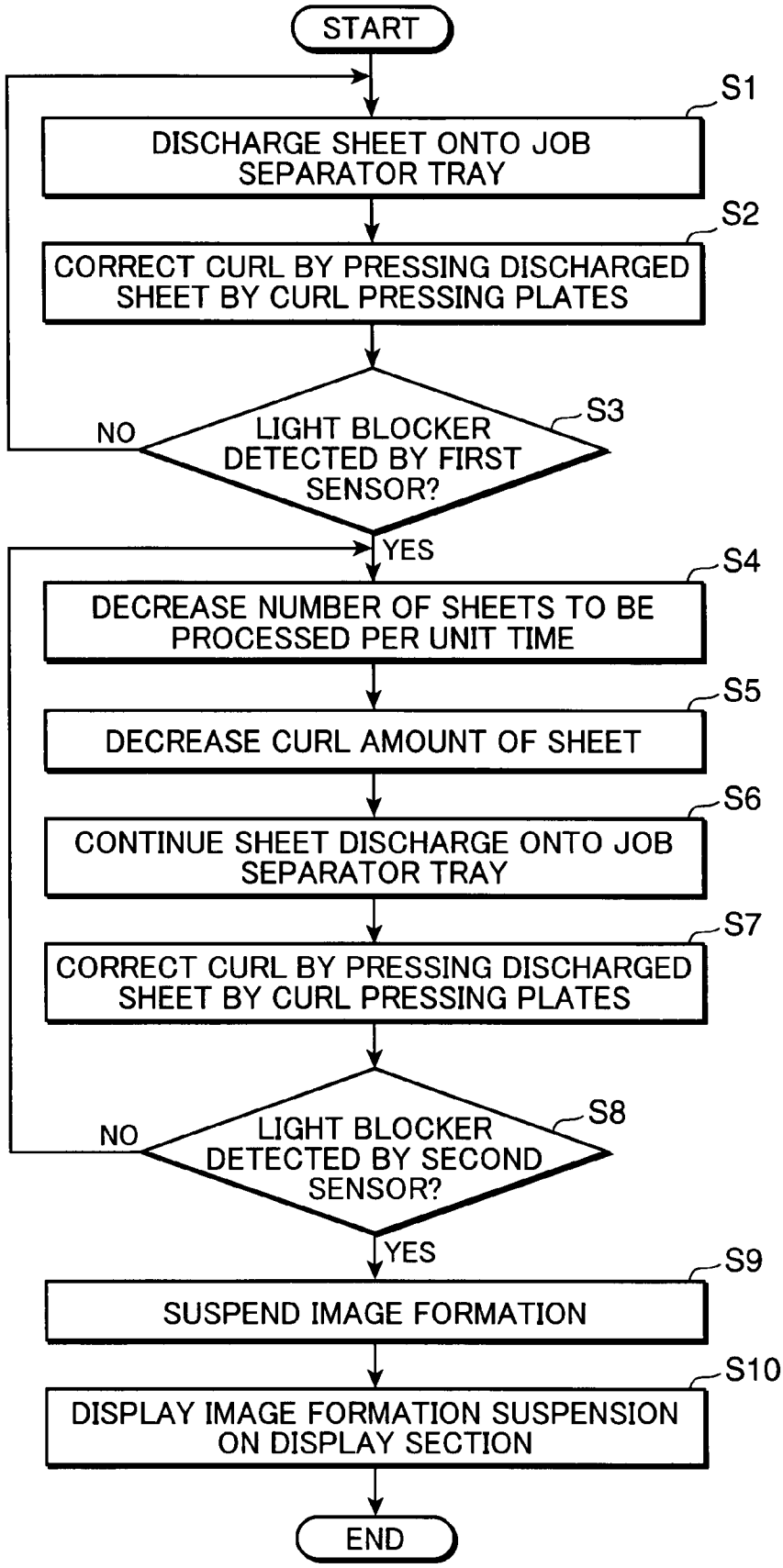
FIG. 6 is a flowchart showing an embodiment of a control flow concerning mode changeover of the copier to be executed by the controller.

In the following, a control flow concerning a mode changeover to be executed by the controller 50 is described based on FIG. 6, referring to FIGS. 1 through 5 according to needs. FIG. 6 is a flowchart showing an embodiment of the control flow concerning the mode changeover of the copier 10 to be executed by the controller 50. In the flowchart, an operation start time is the point of time when the copier 10 is used as a facsimile machine, and a first sheet P after an image formation by data transmission from a sender facsimile machine is discharged onto the job separator tray 162.

First, after a sheet P carrying a transferred toner image is subjected to a fixing operation by the fixing unit 136, the sheet P is discharged onto the job separator tray 162 (Step S1). Then, a lead end of the discharged sheet P is abutted against the curl suppressing plates 32 on the job separator tray 162, and the curl suppressing plates 32 are pivotally moved upward about the axis of the support rod 31. While the curl suppressing plates 32 are pivotally moved upward, the sheet P passes underneath the curl suppressing plates 32. Then, a curl formed on the widthwise ends of the sheet P is corrected when the curl suppressing plates 32 are pivotally moved downward by the own weight thereof to press the sheet P (Step S2).

Then, the light blocker position judger 511 (see FIG. 5) judges whether the first sensor 401 has detected the fan-shaped light blocker 33, based on a detection signal outputted from the first sensor 401 (Step S3). If the fan-shaped light blocker 33 is not detected (NO in Step S3), the routine returns to Step S1 to allow a next sheet P to be discharged onto the job separator tray 162. If, on the other hand, the fan-shaped light blocker 33 is detected (YES in Step S3), the light blocker position judger 511 judges that the operation mode of the copier 10 is to be changed from the normal operation mode to the delay mode, and the control signal output section 512 outputs a control signal to the respective relevant parts of the copier 10 based on the judgment result to reduce the number of sheets P to be processed by the copier 10 per unit time (Step S4).

By reducing the number of sheets P to be processed by the unit time, the transport time interval between the preceding sheet P and the succeeding sheet P is increased. Thereby, the direct contact time of the fixing roller 136*a* with the pressure roller 136*b* is increased, and the surface temperature difference between the fixing roller 136*a* and the pressure roller 136*b* is decreased. Thereby, the curl amount of the sheet P which may be generated by the fixing operation is reduced (Step S5).

Then, the sheet P whose curl amount has been reduced is discharged onto the job separator tray 162 (Step S6). After the sheet P having the reduced curl amount is discharged onto the job separator tray 162, the curl of the sheet P is continued to be corrected while the sheet P is pressed against the curl suppressing plates 32 by the own weight thereof (Step S7).

Then, the light blocker position judger 511 judges whether the second sensor 402 has detected the fan-shaped light blocker 33, in other words, an image formation is to be suspended, based on the detection signal outputted from the second sensor 402 (Step S8). If the fan-shaped light blocker 33 is not detected by the second sensor 402 (NO in Step S8), the routine returns to Step S4. If, on the other hand, the fan-shaped light blocker 33 is detected (YES in Step S8), the control signal output section 512 outputs a control signal to the respective driving parts of the copier 10 i.e. the sheet feeder drive source 54, the image former drive source 55, the charger power source device 56, the exposure unit 132, and the transferer power source device 57 to suspend the driving thereof, based on the judgment result of the light blocker position judger 511. Thereupon, the image formation of the copier 10 is suspended (Step S9).

The information relating to the driving suspended state is outputted and displayed on the display section 58 (Step S10). Thereby, the user is allowed to visually recognize that the image formation of the copier 10 is suspended, and to take a measure such as removing the sheets P stacked on the job separator tray 162.

As described above in detail, the copier 10 according to the embodiment includes: the fixing unit 136, with the fixing roller 136*a* and the pressure roller 136*b*, for performing a fixing operation with respect to the sheet P having a transferred toner image; the job separator tray 162 for stacking the sheet P successively discharged thereon after the fixing operation by the fixing unit 136; and the curl correcting mechanism 20 for correcting a curl of the sheet P which may have been formed during the fixing operation of the fixing unit 136. The curl correcting mechanism 20 corrects the curl of the sheet P discharged on the job separator tray 162.

In the above arrangement, each time the toner image is transferred, and the sheet P after the fixing operation by the fixing unit 136 is discharged and stacked onto the job separator tray 162, the sheet pressing position of the curl correcting mechanism 20 is moved upward while pressing the sheet P to suppress the curl of the sheet P. Thereby, the curl of the sheet P is corrected on the job separator tray 162. In the conventional arrangement of correcting a curl by the upstream-located curl correcting mechanism with respect to the job separator tray, the widthwise ends of the sheet P after the curl correction may return to a curled state before the sheet P reaches the job separator tray 162, and the thickness of the sheets P stacked on the job separator tray 162 may be unduly increased, with the result that the sheet stacking capacity of the job separator tray 162 may be lowered. Unlike the conventional arrangement, the embodiment is advantageous in maximally utilizing the sheet stacking capacity of the job separator tray 162.

Specifically, the sheet P discharged on the job separator tray 162 has its curl corrected while being pressed against the sheet presser 30 on the job separator tray 162. Accordingly, as compared with the conventional arrangement of correcting the curl by the upstream-located curl correcting mechanism with respect to the job separator tray, there is no or less likelihood that the sheet may return to a curled state, thereby maximally utilizing the sheet stacking capacity of the job separator tray 162.

The curl correcting mechanism 20 includes: the sheet presser 30, whose sheet pressing position is moved upward in accordance with an increase in the number of sheets to be discharged on the job separator tray 162 while pressing the uppermost sheet P of the sheet stack on the job separator tray 162 to suppress the curl of the sheet P; the first sensor 401 for detecting the sheet pressing position of the sheet presser 30, and the controller 50 for controlling the number of sheets P to be processed per unit time, based on the detection result of the first sensor 401, if the first sensor 401 detects that the sheet pressing position has exceeded the predetermined reference height position T1.

With the thus-constructed curl correcting mechanism 20, the first sensor 401 detects whether the sheet pressing position of the sheet presser 30 has exceeded the reference height position T1. If the first sensor 401 detects that the sheet pressing position of the sheet presser 30 has exceeded the reference height position T1, the controller 50 controls the relevant parts of the copier 10 to reduce the number of sheets P to be processed per unit time, based on the detection result of the first sensor 401. Thereby, the transport time interval between the preceding sheet P and the succeeding sheet P is increased.

As the transport time interval of sheets P is increased, the pressing contact time of the fixing roller 136*a* with the pressure roller 136*b* is increased. Thereby, the time of transmitting the heat of the fixing roller 136*a* to the pressure roller 136*b* is increased. As a result, the surface temperature difference between the fixing roller 136*a* and the pressure roller 136*b* is decreased, which enables to reduce the curl amount of the sheet P resulting from a temperature difference between both surfaces of the sheet P passing through the nip portion N between the fixing roller 136*a* and the pressure roller 136*b*. Thus, since the curl amount of the sheet P to be discharged after increase of the transport time interval of sheets P is reduced, the arrangement is advantageous in maximally utilizing the sheet stacking capacity of the job separator tray 162.

Also, the second sensor 402 is provided to detect the maximally loadable position T2 of sheets P to be stacked on the job separator tray 162. The controller 50 suspends a sheet discharging operation based on a detection result of the second sensor 402 that the sheet presser 30 has reached the maximally loadable position T2. With this arrangement, no more sheet P is discharged on the job separator tray 162 after the second sensor 402 detects that the sheet presser 30 has reached the maximally loadable position T2. Thus, the arrangement is advantageous in securely preventing likelihood that a further sheet P may be discharged on the job separator tray 162 over the sheet stacking capacity of the job separator tray 162, thereby causing sheet jam.

Further, the sheet presser 30 includes the support rod 31 which is provided above the job separator tray 162 and extends in the sheet widthwise direction substantially orthogonal to the sheet discharge direction; and the curl suppressing plate pair 32 in the sheet widthwise direction, each of which is suspended by the own weight when an external force is not applied, and is pivotally supported about the axis of the support rod 31. The curl suppressing plates 32 each is pivotally moved upward by being pushed by the lead end of the sheet P which is being discharged onto the job separator tray 162, and then pivotally moved downward by the own weight to pressingly correct the curl of the sheet P.

In the above arrangement, when the sheet P is discharged onto the job separator tray 162, the lead end of the sheet P pushes the curl suppressing plates 32 which are suspended by the own weight in the sheet discharge direction. Thereby, the curl suppressing plates 32 are pivotally moved upward about the axis of the support rod 31, allowing the sheet P to pass underneath the lower end of the curl suppressing plates 32 and to be discharged onto the job separator tray 162. Thereafter, the curl suppressing plates 32 are pivotally moved downward about the axis of the support rod 31 by the own weight in such a direction as to press the sheet P to suppress the curl of the sheet P. Thereby, the curl of the sheet P is corrected on the job separator tray 162.

In this way, the sheet presser 30 is provided with the support rod 31 extending in the sheet widthwise direction; and the curl suppressing plate pair 32 in the sheet widthwise direction, each of which is suspended by the own weight when an external force is not applied, and is pivotally rotatable about the axis of the support rod 31. This arrangement enables to securely correct the curl of the sheet P on the job separator tray 162, in addition to the advantage that the construction of the sheet presser 30 is simplified, which contributes to reduction of the cost relating to the parts of the copier 10.

The invention is not limited to the foregoing embodiment, but may embrace the following modifications.

(1) In the embodiment, the copier 10, which is a complex machine having a function as a facsimile machine, is described as an example of the image forming apparatus embodying the invention. Alternatively, the invention may be applied to an image forming apparatus having a single image forming function such as a copier, a facsimile machine, or a printer operatively connected to a computer or a like external device.

(2) In the embodiment, the curl correcting mechanism 20 is provided on the job separator tray 162. Alternatively, the curl correcting mechanism 20 may be provided on the primary discharge tray 152, or on a discharge tray provided at a top part of the copier main body 11, or on an externally-provided discharge tray.

(3) In the embodiment, the transferer 134 is provided with the transfer roller. Alternatively, the transferer 134 may be provided with a transfer belt, in place of the transfer roller.

(4) In the embodiment, the charger 131 is provided with the charging wire. Alternatively, the charger 131 may be provided with a charging roller, in place of the charging wire.

(5) In the embodiment, the position sensor 40 for detecting the position of the curl suppressing plate 32 is a photosensor provided with the light emitter 421 and the light receiver 431. Alternatively, various sensors may be provided such as a switching sensor for turning on and off a predetermined switch depending on a change in position of the curl suppressing plate 32, or a capacity sensor or a resistance sensor for detecting the position of the curl suppressing plate 32 depending on a change in electrical capacity or resistance value concerning the fan-shaped light blocker 33 in accordance with a change in pivotal position of the fan-shaped light blocker 33.

(6) In the embodiment, the curl suppressing plate 32 is mounted on the support rod 31 in pair. Alternatively, a single curl suppressing plate may be provided substantially over the entire length of the support rod 31. In the modification, the middle portion of the single curl suppressing plate 32 does not serve as a curl corrector, but serves as a weight for increasing the own weight of the curl suppressing plate 32.

(7) In the embodiment, the curl suppressing plates 32 are designed to press the sheet P on the job separator tray 162 merely by their own weights. Alternatively, a bias member such as a coil spring, a torsion spring, or a plate spring may be additionally provided to press the sheet P by a biasing force thereof. In the modification, it is possible to form the curl suppressing member 32 of a lightweight material such as a synthetic resin material, which enables to widen a selection range of the material for the curl suppressing plates 32. Further alternatively, a heavy metal member such as a lead member may be attached to the curl suppressing members 32 as a weight, in place of the bias member.

The foregoing embodiment and/or modifications primarily include the inventions having the following arrangements.

An image forming apparatus according to an aspect of the invention includes: an image former for performing an image formation by transferring a toner image onto a sheet; a fixing unit for performing a fixing operation with respect to the toner image on the sheet by heating; a discharge tray for successively stacking the sheet to be discharged after the fixing operation; and a curl correcting mechanism for correcting a curl of the sheet to be discharged onto the discharge tray after the fixing operation.

In the above arrangement, each time the toner image is transferred, and the sheet after the fixing operation by the fixing unit is discharged and stacked on the discharge tray, the curl correcting mechanism corrects the curl of the sheet on the discharge tray. In the conventional arrangement of correcting a curl by the upstream-located curl correcting mechanism with respect to the discharge tray, the sheet after the curl correction may return to a curled state before the sheet reaches the discharge tray, and the thickness of the sheets stacked on the discharge tray may be unduly increased, with the result that the sheet stacking capacity of the discharge tray may be lowered. Unlike the conventional arrangement, the arrangement of the invention is advantageous in maximally utilizing the sheet stacking capacity of the discharge tray.

Preferably, the curl correcting mechanism includes a sheet presser which is operated in such a manner that a sheet pressing position thereof is moved upward in accordance with an increase in the number of sheets to be discharged onto the discharge tray, while pressing the sheet on the discharge tray to suppress the curl of the sheet.

In the above arrangement, each time the sheet is discharged onto the discharge tray, the sheet pressing position of the sheet presser is moved upward while the sheet presser presses the sheet to suppress the curl of the sheet. Thereby, the curl of the sheet to be stacked on the discharge tray is corrected while the sheet is pressed by the sheet presser.

Preferably, the sheet presser includes: a support rod disposed above the discharge tray, and extending in a sheet widthwise direction substantially orthogonal to a sheet discharge direction; and a curl suppressing plate which is suspended from the support rod, and is pivotally supported about an axis of the support rod, wherein the curl suppressing plate is pivotally moved upward while being pushed by a lead end of the sheet being discharged onto the discharge tray to allow the sheet to pass underneath the curl suppressing plate, and is pivotally moved downward to press the sheet.

In the above arrangement, when the sheet is discharged onto the discharge tray, the curl suppressing plate, which has been suspended by the own weight thereof, is pushed by the lead end of the sheet in the sheet discharge direction. Then, the curl suppressing plate is pivotally moved upward about the axis of the support rod to allow the sheet to pass underneath the curl suppressing plate, thereby discharging the sheet onto the discharge tray. Thereafter, the curl suppressing plate is pivotally moved downward by the own weight to press the sheet, whereby the curl of the sheet is corrected on the discharge tray. Since the sheet presser is constituted of the support rod and the curl suppressing plate, the curl of the sheet on the discharge tray is securely corrected, in addition to the advantage that the construction of the sheet presser is simplified, thus contributing to reduction of the parts cost.

Preferably, the image forming apparatus further includes: a controller for controlling a processing performance of the image former, wherein the controller controls the image former to lower the processing performance, if it is judged that the sheets are stacked on the discharge tray over a predetermined amount.

Preferably, the curl correcting mechanism includes a sheet presser which is operated in such a manner that a sheet pressing position thereof is moved upward in accordance with an increase in the number of sheets to be discharged onto the discharge tray, while suppressing the curl of the sheet on the discharge tray. The image forming apparatus further includes: a first detecting member for detecting the sheet pressing position of the sheet presser; and a controller for controlling the image former to reduce the number of the sheets to be processed by the image former per unit time by increasing a transport time interval between a preceding sheet to be processed by the image former, and a succeeding sheet to be processed by the image former, if the first detecting member detects that the sheet pressing position has exceeded a predetermined reference height level.

In the above arrangement, when the first detecting member detects that the sheet pressing position of the sheet presser has exceeded the reference height level, the controller controls the image former to reduce the number of sheets to be processed per unit time, based on the detection result of the first detecting member, by increasing the transport time interval between the sheets. When the transport time interval between the sheets is increased, the pressing contact time of the fixing roller with the pressure roller is increased. Thereby, the time of transmitting the heat of the fixing roller to the pressure roller is increased. As a result, the surface temperature difference between the fixing roller and the pressure roller is decreased, which enables to reduce the curl amount resulting from the temperature difference between the both surfaces of the sheet which passes through the nip portion between the fixing roller and the pressure roller. Thus, if it is detected that the height level of the sheets stacked on the discharge tray has exceeded the reference height level, the curl amount of the sheet to be discharged onto the discharge tray is reduced, which enables to prevent the sheet stacking capacity of the discharge tray from lowering after the detection.

Preferably, the image forming apparatus further includes: a second detecting member for detecting a height level of the sheets to be stacked on the discharge tray, wherein the controller controls the image former to suspend a sheet discharging operation, if the second detecting member detects that the sheet pressing position has reached a predetermined maximally loadable level corresponding to a maximum height level of the sheets loadable on the discharge tray.

In the above arrangement, if the second detecting member detects that the sheet pressing position has reached the maximally loadable level, the controller causes the image forming apparatus to suspend the sheet discharging operation. This enables to prevent likelihood that a further sheet may be discharged onto the discharge tray after the detection, thereby causing sheet jam.

This application is based on Japanese Patent Application No. 2006-224140 filed on Aug. 21, 2006, the contents of which are hereby incorporated by reference.

Although the invention has been appropriately and fully described by way of examples with reference to the accompanying drawings, it is to be understood that various changes and/or modifications will be apparent to those skilled in the art. Therefore, unless otherwise such changes and/or modifications depart from the scope of the present invention hereinafter defined, they should be construed as being included therein.

What is claimed is:

1. An image forming apparatus, comprising:

an image former for performing an image formation by transferring a toner image onto a sheet;

a fixing unit for performing a fixing operation with respect to the sheet having the transferred toner image by heating;

a discharge tray for successively stacking the sheet to be discharged after the fixing operation; and a curl correcting mechanism for correcting a curl of the sheet to be discharged onto the discharge tray after the fixing operation, the curl correcting mechanism including a sheet presser which is operated in such a manner that a sheet pressing position thereof is moved upward in accordance with an increase in the number of sheets to be discharged onto the discharge tray, while suppressing the curl of the sheet on the discharge tray;

a detector for detecting a sheet pressing position of the sheet presser;

a controller for controlling the image former to reduce the number of sheets to be processed by the image former per unit time if the detector detects that the sheet pressing position has exceeded a predetermined reference height level, and suspends a sheet discharging operation if the detector detects that the sheet pressing position has reached a predetermined maximally loadable level corresponding to a maximum height level of the sheets loadable on the discharge tray.

2. The image forming apparatus according to claim 1, wherein the sheet presser includes:

a support rod disposed above the discharge tray, and extending in a sheet widthwise direction substantially orthogonal to a sheet discharge direction; and a curl suppressing plate which is suspended from the support rod, and is pivotally supported about an axis of the support rod, wherein the curl suppressing plate is pivotally moved upward while being pushed by a lead end of the sheet being discharged onto the discharge tray to allow the sheet to pass underneath the curl suppressing plate, and is pivotally moved downward to press the sheet.

3. An image forming apparatus comprising:

an image former for performing an image formation by transferring a toner image onto a sheet;

a fixing unit for performing a fixing operation with respect to the sheet having the transferred toner image by heating;

a discharge tray for successively stacking the sheet to be discharged after the fixing operation;

a curl correcting mechanism for correcting a curl of the sheet to be discharged onto the discharge tray after the fixing operation, the curl correcting mechanism including a sheet presser which is operated in such a manner that a sheet pressing position thereof is moved upward in accordance with an increase in the number of sheets to be discharged onto the discharge tray, while suppressing the curl of the sheet on the discharge tray;

a first detecting member for detecting the sheet pressing position of the sheet presser; and a controller for controlling the image former to reduce the number of sheets to be processed by the image former per unit time by increasing a transport time interval between a preceding sheet to be processed by the image former, and a succeeding sheet to be processed by the image former, if the first detecting member detects that the sheet pressing position has exceeded a predetermined reference height level.

4. The image forming apparatus according to claim 3, further comprising:

a second detecting member for detecting a height level of the sheets to be stacked on the discharge tray, wherein the controller controls the image former to suspend a sheet discharging operation, if the second detecting member detects that the sheet pressing position has reached a predetermined maximally loadable level corresponding to a maximum height level of the sheets loadable on the discharge tray.

5. The image forming apparatus according to claim 4, wherein the sheet presser includes:

a support rod disposed above the discharge tray, and extending in a sheet widthwise direction substantially orthogonal to a sheet discharge direction; and a curl suppressing plate which is suspended from the support rod, and is pivotally supported about an axis of the support rod, wherein the curl suppressing plate is pivotally moved upward while being pushed by a lead end of the sheet being discharged onto the discharge tray to allow the sheet to pass underneath the curl suppressing plate, and is pivotally moved downward to press the sheet.

6. The image forming apparatus according to claim 5, further comprising a light-blocker fixedly attached on the support rod, wherein the first and second detecting members optically sense the light-blocker to detect the sheet pressing position of the sheet presser.

7. The image forming apparatus according to claim 2, further comprising a light-blocker fixedly attached on the support rod, wherein the detector optically senses the light-blocker to detect the sheet pressing position of the sheet presser.

* * * * *